United States Patent [19]

Ahn et al.

[11] 4,001,061

[45] Jan. 4, 1977

[54] SINGLE LITHOGRAPHY FOR MULTIPLE-LAYER BUBBLE DOMAIN DEVICES

[75] Inventors: Kie Y. Ahn, Chappaqua; Michael Hatzakis, Ossining; John V. Powers, Shenorock, all of N.Y.

[73] Assignee: International Business Machines Corporation, Armonk, N.Y.

[22] Filed: Mar. 5, 1975

[21] Appl. No.: 555,644

[52] U.S. Cl. ..... 156/3; 96/36.2; 156/7; 156/12; 204/15; 204/23; 427/96; 427/259

[51] Int. Cl.[2] ..... C23F 1/02

[58] Field of Search ..... 29/578, 625, 174 R, 29/604; 96/36, 36.2; 156/3, 7, 11, 12, 17; 427/43, 130, 131, 259, 264, 265, 272, 282, 287; 340/174; 204/15, 23, 32 R

[56] References Cited

UNITED STATES PATENTS

| | | | |
|---|---|---|---|
| 2,728,693 | 12/1955 | Cado | 156/8 |
| 2,912,312 | 11/1959 | Japel | 156/8 |
| 3,075,866 | 1/1963 | Baker et al. | 156/11 |
| 3,443,915 | 5/1969 | Wood et al. | 29/194 |
| 3,649,393 | 3/1972 | Hatzakis | 156/12 |
| 3,832,176 | 8/1974 | Verstraete et al. | 96/36 |

*Primary Examiner*—William A. Powell
*Attorney, Agent, or Firm*—Jackson E. Stanland

[57] ABSTRACT

A fabrication process for fabricating multiple layer magnetic bubble domain devices using only a single masking step. As a specific example, a thin conductor film (which could be a magnetic material, such as NiFe) is deposited on a substrate comprising a magnetic bubble domain material. This conductor film is coated with a resist which is exposed with an electron beam or an X-ray beam. The exposure density in a first area of the resist is different than that in a second area of the resist. Subsequent development of the resist will uncover the thin film only in the area which has received the greater exposure density. This area can then be used as a plating base for electro-plating another conductive layer, such as a thick gold film. Further development of the resist is used to uncover the second area (which initially received a lower exposure density). Another layer then can be plated which will plate onto the thin conductive base film which is now uncovered and onto the second conductive layer which was formed in the previous electro-plating step. After this, the remaining resist and the unwanted remaining thin film is etched away to leave a final circuit structure.

9 Claims, 9 Drawing Figures

SINGLE LITHOGRAPHY FOR MULTIPLE-LAYER BUBBLE DOMAIN DEVICES

BACKGROUND OF THE INVENTION

1. Field of the Invention

This invention relates to fabrication processes for forming magnetic bubble domain devices, and in particular to fabrication processes providing multiple layer bubble domain devices using only a single masking step.

2. Description of the Prior Art

In the fabrication of magnetic bubble domain devices, it is frequently necessary to deposit multiple magnetic layers in precise alignment with one another. At the same time, it is often necessary that different materials or combinations thereof be placed in different areas of the same circuit structure. For example, it may be desirable to have a high conductivity electrical layer such as gold located between two layers of magnetic material, where one of the layers is used for moving the bubble domains while the other is used as a bubble domain sensor. Additionally, it may also be desirable to place a layer of magnetoresistive material, such as NiFe, in a sensor area of the circuit in order to detect the presence or absence of a bubble domain thereat.

Most processes for fabricating magnetic bubble domain circuits use a plurality, of masking steps to provide the multiple layer structures. For instance, IBM Technical Disclosure Bulletin Volume 15, No. 6, November 1972, p. 1826 describes an example of the prior art processes. In this process, a plurality of masking steps requiring a plurality of alignments is required.

In contrast with a process involving several masking steps, attempts have been made to provide single masking step processes. One such attempt is described in an article by A. H. Bobeck et al which appears in the IEEE Transactions on Magnetics, Volume MAG-9, No. 3, September 1973, at page 474. In the fabrication process described therein, a shadow mask is used to protect the sensor area of the circuit structure during deposition of conductor lines. However, this process has disadvantages when full wafer processing and small bubble domain sensors are utilized. During such processing, the provision of shadow masks requires some alignment when full wafer processing is utilized and the sensor areas to be defined are very small.

Thus, in the prior art, multiple layers of films in bubble domain devices are conventionally formed by the use of multiple masks and multiple photoresists in order to define the respective areas in which each of the layers is to be deposited. It is also possible to use scanned or "programmed" electron beams for this purpose. However, provision of either of these two methods is difficult since it is difficult to align the masks or electron beams precisely when going from one layer deposition to the next. This problem becomes increasingly acute as the sizes of individual devices components are reduced. Accordingly, even the two masking step approach described in the Bobeck et al article has serious disadvantages.

Accordingly, it is a primary object of the present invention to provide a fabrication process for formation of magnetic bubble domain devices using only a single masking step.

It is another object of this invention to provide a fabrication process for making magnetic bubble domain devices using only a masking step, which can be used to provide devices having multiple metallic layers where these layers can be interchanged in their order of deposition.

It is a still further object of this invention to provide an improved fabrication process for making magnetic bubble domain devices which can be used with a plurality of materials and for provision of devices having any number of layers.

SUMMARY OF THE INVENTION

This invention utilizes the fact that resist layers can be selectively developed in accordance with the exposure density to which they have been subjected in order to provide differential development patterns. Utilization of this property leads to the result that a bubble domain device fabrication process can be obtained which uses only one masking step. In the practice of this process, the materials used for the various layers are not limited by the process itself and the order in which the various layers are formed can be modified in accordance with the designer's requirements. Additionally, a multiple layer magnetic device can be formed using a radiation pattern which is uniform. Provision and use of a mask which produces a different effect even in the presence of a uniform radiation pattern will lead to the same result — namely a multiple layer structure which does not require precise alignment of multiple masks in its fabrication.

In one embodiment of the process, a first conductive layer is placed on a substrate comprising a magnetic bubble domain layer (which may have a non-magnetic spacer layer on it), such as a garnet or an amorphous film. This conductive layer is coated with a resist layer which is then exposed with an electron beam or an X-ray beam where the exposure density in different areas of the resist layer is different. During subsequent development, the portion of the resist subjected to the higher exposure density will be removed while the remaining resist will not be removed. This uncovers the conductive thin film in only a selected area. Accordingly, a second conductive film can be deposited on the exposed portion of the first conductive film. Further development of the resist layer will uncover the areas of the resist which have received the second exposure density. A subsequent deposition step then places a third layer on the second deposited layer and on the first conductive film where it has now been uncovered. Thus, a circuit structure comprising three layers is provided using only a single masking step. At this time, the remaining resist and the unwanted remaining film layers are removed.

These and other objects, features, and advantages, as well as modifications obvious to those of skill in the art, will become apparent from the following more particular description of the preferred embodiments.

DESCRIPTION OF THE PREFERRED EMBODIMENTS

Figure 1:
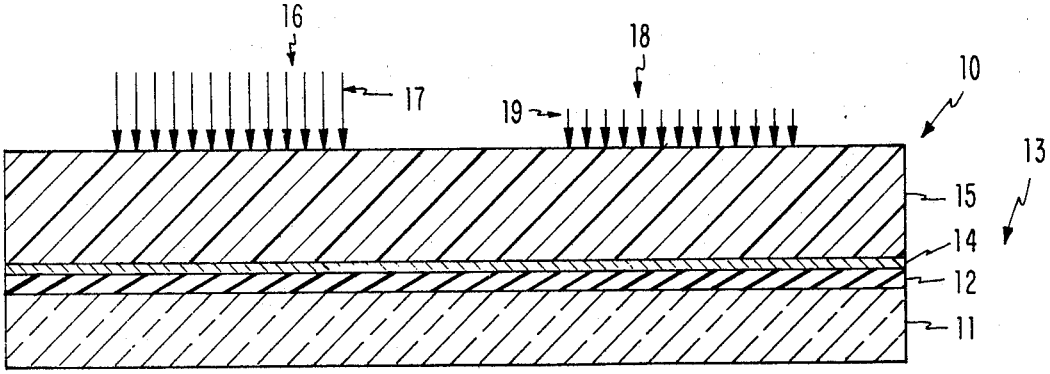
FIG. 1 is a schematic showing a resist-coated substrate being exposed to radiation.

FIG. 1 shows a magnetic bubble domain device 10 having a conventional layer 11 for supporting magnetic bubbles and a non-magnetic spacer layer 12, which is optional (in some circuits, the spacer 12 may not be needed). Layer 11 is supported on a substrate, not shown. For purposes of the present invention, however, the layers 11 and 12 and any necessary mechanical support may be collectively termed a substrate 13, since these elements are not modified in fabricating the remainder of the device.

This composite substrate 13 is first covered with a thin film 14 of an electrically conductive material, for subsequent electroplating. Film 14 is relatively thin, preferably having a thickness of about 30 nanometers (nm) or less. For bubble devices, film 14 is preferably composed of a magnetic material such as NiFe. As will be more fully appreciated later, film 14 can be comprised of a magnetoresistive material (such as NiFe) in order to serve as a bubble domain sensor. Thus, the film 14 can have two functions: 1) a bubble domain sensor, and 2) a plating base for subsequent layers. Next, film 14 is coated with a uniform layer 15 of resist such as polymethyl methacrylate (PMMA). The use of PMMA as a resist is shown, e.g., in U.S. Pat. No. 3,535,137.

Resist layer 15 is next exposed to radiation whose exposure density varies at different areas. In an area 16 destined to become a bubble domain propagation area, the radiation has a higher intensity, as shown schematically by the arrows 17 in FIG. 1 than that in an area 18, which is to be made a sensor area. Arrows 19 depict a lower intensity. Other areas do not receive any appreciable radiation. Exposure of resist 15 may be performed by conventional electron-beam techniques, in which case the differing intensities may be achieved by varying the beam strength in different areas. Resist 15 may also be exposed with X-rays. Since it is difficult to vary X-ray intensities at different locations, device 10 may be covered by a master mask and exposed to a uniform X-ray field. A mask suitable for this purpose will be described in connection with FIGS. 6–9.

Figure 2:
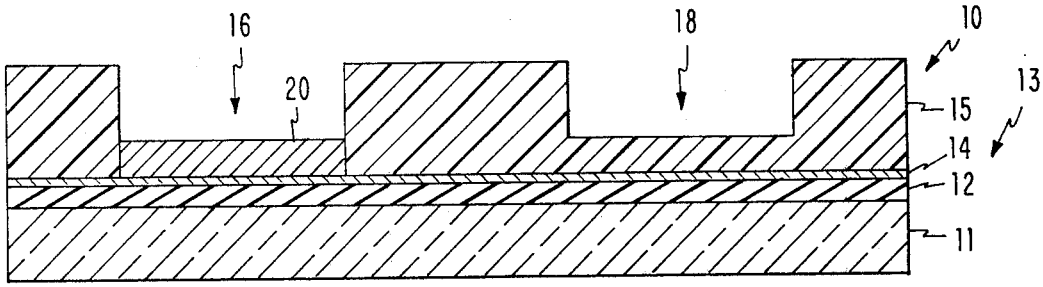
FIG. 2 shows the partially developed resist and the plating of a metallic layer.

In FIG. 2, resist layer 15 has been only partially developed. Variable-intensity exposure and partial development of a photoresist coating are shown in U.S. Pat. No. 3,649,393 to M. Hatzakis. In addition, U.S. Pat. No. 3,536,547 shows the use of electron beams or ion bombardment of layers in order to make them more sensitive to etching solutions. Since the radiation was more intense in area 16, its entire thickness has been depolymerized in this area, so that removal of the resist by washing will expose layer 14 in the area. But, since area 17 has received less radiation density, only a portion of thickness of resist 15 will be removed in the latter area. A thicker layer 20 is then electroplated on layer 14 only in propagation area 16. Layer 20 may be a film of gold or other conducting material about 200-500 nm thick. The thickness of layer 20 is generally chosen to give good electrical conductivity, in accordance with the currents required in the circuits to be formed. For instance, the thickness of layer 20 is chosen so that adverse electromigration will not occur in conductor 20. Gold is employed in this application primarily because it is a better electrical conductor than the NiFe of layer 14.

Figure 3:
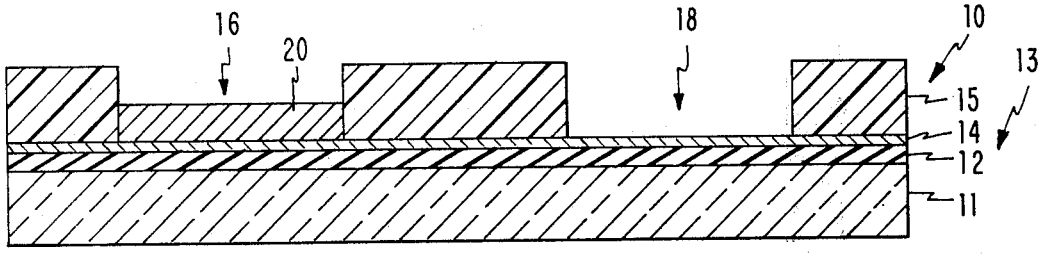
FIG. 3 shows the completely developed resist.
Figure 4:
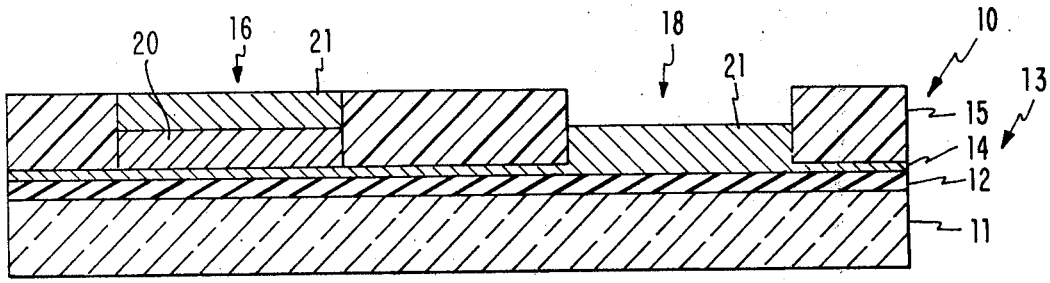
FIG. 4 depicts the plating of another metallic layer.

In FIG. 3, resist layer 15 has been fully developed. The developed resist uncovers thin layer 14 in sensor area 18, while leaving it intact in other areas. FIG. 4 shows the addition of a second electroplated layer 21. For a magnetic bubble device, this layer is preferably of NiFe and is about 300 nm thick. Layer 21 plates over gold layer 20 in propagation area 16, and increases the NiFe thickness in sensor area 18.

The unexposed resist 15 in FIG. 4 is then dissolved with a conventional solvent. Next, the surface of devices 10 is etched in a conventional manner (sputter etched or ion-milled) in order to remove layer 14 from substrate layer 12 except in the areas 16 and 18, Since layer 14 is substantially thinner than layers 20 and 21, the etching removes only a small amount of the latter two layers.

Figure 5:
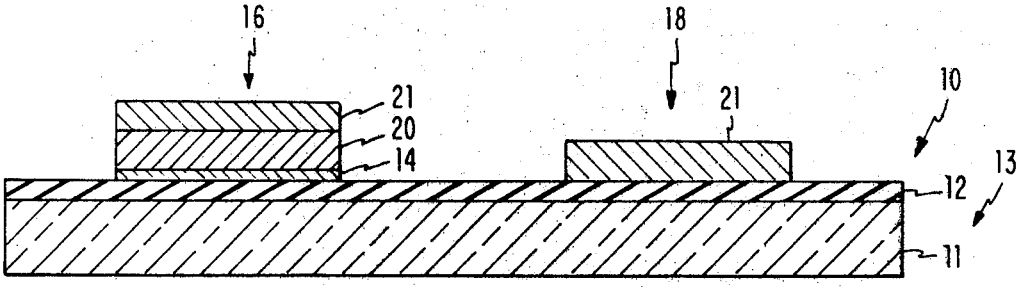
FIG. 5 shows the removal of a thin metallic layer between different areas.

FIG. 5 shows the finished form of device 10, after layer 14 has been removed. Propagation area 16 contains three different metallic layers: a magnetic layer 14 of NiFe, a highly conductive layer 20 of gold, and another NiFe layer 21. Sensor area 17 has a single magnetic NiFe layer formed from the original layer 14 and the subsequently plated material 21. Since layer 12 is a dielectric, non-magnetic spacer areas 16 and 18 are electrically isolated.

As was mentioned earlier, the materials used in the various layers can be changed. For instance, if layer 14 is not to be used as a sensor, it need not be magnetic. In this case, it would be a conductive layer to serve as a plating base, while the bubble domain sensor would be a thick sensor comprising a portion of layer 21.

FIGS. 6–9 show a method for making a multiple-density mask 30 which may be used in providing variable-intensity radiation in fabricating device 10, FIG. 1 from X-ray or other uniform-density radiation fields. This method and others are described in a copending application of M. Hatzakis, Ser. No. 489,853, filed Apr. 6, 1976, which is a continuation of Ser. No. 489,853, filed July 19, 1974, now abandoned.

Figure 6:
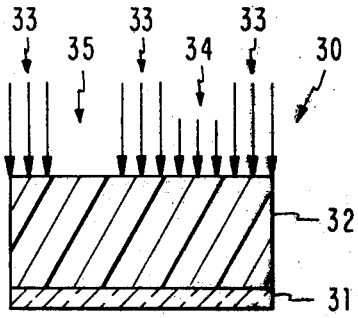
FIGS. 6–9 illustrate the steps of one process for making a mask useful in practicing the invention.

The method shown in FIGS. 6–9 employs an additive process. In FIG. 6, mechanical mask support 31 is first coated with a positive resist 32 such as PMMA. A variable-intensity electron beam or other programmed radiation source exposes resist 32 with a high intensity in areas 33 and a lower intensity in area 34, as indicated by the arrows. Area 35 receives essentially no radiation. Resist 15 is then partially developed so as to uncover support 31 in the areas 33. The partial development reduces the thickness of resist 32 in area 34, and leaves the full thickness in area 32.

Figure 7:
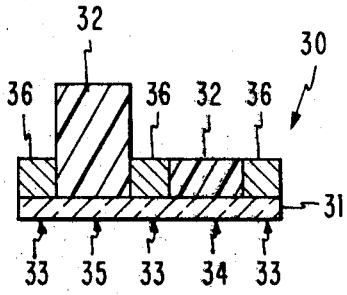
Figure 8:
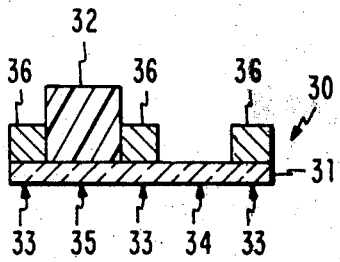
Figure 9:
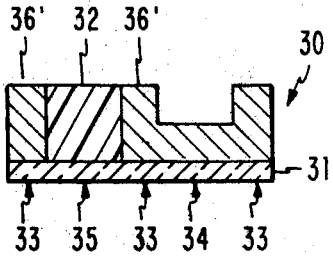

FIG. 7 shows a layer 36 of opaque material deposited on support 31 by electroplating or any other conventional method. Gold is a suitable material for layer 36 if mask 30 is to be used for X-ray irradiation. Since only the areas 33 of support 31 were uncovered by the partial development of resist 32, layer 32 adheres only to those areas. FIG. 8 depicts the full development of resist 32. Because area 34 of support 31 is now uncovered, the subsequent electroplating of material such as gold results in a layer 36', FIG. 9, having a greater thickness in areas 33 than in areas 34. Undeveloped resist 32 still covers area 34; this resist may now be dissolved with a conventional solvent.

The method of FIGS. 6–9 may obviously employ conventional negative resists, such a KTFR (trademark of Eastman Kodak Co.), instead of positive resists. Additional steps of partial resist development may also be employed in conjunction with further different radiation densities to attain a greater number of different mask thicknesses.

What has been shown is a method for fabricating magnetic bubble domain circuits using a single masking step to provide multi-layer structures. The order of deposition of the various layers may be interchanged, and the material used in the various layers can be chosen in accordance with the designer's requirements. For instance, while NiFe is a suitable magnetic material, materials such as CoNi and FeCo can also be used. Also, it will be recognized that a deposition technique other than electroplating can be used but those other techniques (such as evaporation) are not as advantageous, especially when small line widths are desired. The method is characterized by a selective treatment of a radiation sensitive layer, such as a resist layer, to provide regions therein which can be selectively treated to expose different regions of an underlying area, which then acts as a plating base for subsequent layer formation. Electron beams, X-rays and optical radiation can be used.

As an example of the present process, a bubble domain apparatus was made by the following method. A first layer 14 of NiFe having a thickness of 30 nm was deposited on a $SiO_2$ spacer layer 12, of 200 nm thickness. The bubble domain medium 11 was a GdCoMo amorphous alloy, of about 1 micron thickness. The resist 15 having about 800 nm thickness was subjected to different radiation intensities to define areas 16 and 17, which were later used for sensing and propagation, respectively. The accelerating potential for the electron gun was 15–20 kV, and there was a factor of two in the radiation intensity on the areas 16 and 17. On one of these areas, the electron beam intensity was $10^{-4}$ coul/cm$^2$ while on the other area, the intensity was $5 \times 10^{-5}$ coul/cm$^2$. The conductor layer 20 was Au having a thickness of 350 nm. The sensor and propagation layer 21 was NiFe of thickness 250 nm. The linewidth of the patterns formed for the bubble domain circuits was one micron. The sense signal obtained was 1 mV/mA of current through the sensor.

What is claimed is:

1. A method for fabricating a magnetic bubble domain device, comprising the steps of;

a. depositing a first thin magnetic film on a substrate having a bubble material therein, said magnetic film having a thickness less than about 30 nm;

b. coating said thin film with a resist;

c. exposing said resist in a sensor area and a propagation area with a radiation beam having a different exposure density in said propagation area than in said sensor area;

d. partially developing said resist, so as to expose said thin film only in said sensor area;

e. electroplating on said first magnetic film a second film of a metal having a conductivity higher than that of magnetic film, said second film having a thickness greater than about 200 nm;

f. further developing said resist, so as to expose said first thin film in said propagation area;

g. electroplating a third film onto said first magnetic film in said propagation area, said third film being a magnetic film used to propagate said magnetic bubble domains;

h. removing any remaining undesired resist and any remaining undesired first magnetic film.

2. The method of claim 1, where said first conductive film is comprised of a magnetoresistive material.

3. A method for fabricating magnetic bubble domain devices, comprising:

forming a first magnetic conductive film on a substrate comprising a magnetic medium in which said bubble domains can exist, coating said first magnetic conductive film with a resist layer, exposing said resist with radiation, there being a different exposure density in first and second areas of said resist, partially developing said resist layer to remove said resist completely from said first area only partially in said second area, electro-plating a second non-magnetic conductive film on said first film in said first area, further developing said resist to remove said resist completely from said second area, electro-plating a third magnetic conductive film on said previously deposited films in said first and second areas, further developing said resist to remove undesired portions of said resist, removing undesired portions of said first magnetic conducitve film from said substrate except in said fist and second areas.

4. A method for fabricating magnetic bubble domain devices, comprising:

forming a first magnetic conductive film on a substrate comprising a magnetic medium in which said bubble domains can exist, coating said first magnetic conductive film with a resist layer, exposing said resist with radiation, there being a different exposure density in first and second areas of said resist, partially developing said resist layer to remove said resist completely from said first area and only partially in said second area, electro-plating a second magnetic conductive film on said first film in said first area, further developing said resist to remove said resist completely from said second area, electro-plating a third non-magnetic conductive film on said previously deposited films in said first and second areas, further developing said resist to remove undesired portions of said resist, removing undesired portions of said first magnetic conductive film from said substrate except in said first and second areas.

5. A method for fabricating magnetic bubble domain devices, comprising:

depositing a bubble domain sensor layer on a substrate comprising a magnetic medium in which said bubble domains can exist, said sensor layer being used to detect bubble domains in said magnetic medium, coating said sensor layer with a resist layer, differentially treating said resist layer to provide first and second areas which develop at different rates, developing said resist layer to remove said resist completely in said first area to expose said bubble domain sensor layer therein and partially in said second area, electro-plating a second conductive film on exposed portions of said first sensor layer using said exposed sensor layer as a plating base, further developing said resist layer to remove said resist in said second area, to expose said sensor layer in said second area, electro-plating a third conductive layer on the exposed portions of said sensor layer in said second area and onto said second conductive layer in said first area, removing undesired portions of the remaining said resist layer and said sensor layer except in said first and second areas.

6. The method of claim 5, where said second conductive layer is a non-magnetic electrical conductor and said third conductive layer is a magnetic layer used to move magnetic bubble domains in said magnetic medium.

7. A method for making a magnetic bubble domain device, comprising the steps of:

forming a first conductive layer on a substrate comprising a magnetic material in which said domains can exist, coating said conductive layer with a resist layer, differentially exposing said resist layer to create first and second areas therein which can be differentially developed, developing said resist layer to remove said resist layer completely in said first area and partially in said second area, electro-plating propagation circuitry for moving bubbles in said magnetic medium and sensing circuitry for detecting bubbles in said magnetic medium, said propagating circuitry and said sensing circuitry comprising a conductive magnetic layer electroplated in said first area using said exposed first conductive layer as a plating base, further developing said resist layer to remove said resist layer completely from said second area to expose said first conductive layer thereat, electro-plating a non-magnetic conductive layer on said conductive magnetic layer and on said first conductive layer in said second area, said non-magnetic conductive layer providing electrical connections to said sensing circuitry, removing any undesired remaining portions of said resist layer and further removing any undesired remaining portions of said first conductive layer except in said first and second areas.

8. A method for fabricating magnetic bubble domain devices, comprising:

depositing a sensor layer on a substrate comprising a magnetic medium in which said bubble domains can exist, said sensor layer being used to detect bubble domains in said magnetic medium, coating said sensor layer with a resist layer, differentially treating said resist layer to provide first and second areas which develop at different rates, developing said resist layer to remove said resist completely in said first area to expose said sensor layer therein and partially in said second area, forming a second conductive film on exposed portions of said first sensor layer, further developing said resist layer to remove said resist in said second area, to expose said sensor layer in said second area, forming a third conductive layer on the exposed portions of said sensor layer in said second area and onto said second conductive layer in said first area, one of said second and third layers being suitable for moving said bubble domains in said magnetic medium, removing undesired portions of the remaining resist layer and the sensor layer except in said first and second areas.

9. A method for making a magnetic bubble domain device, comprising the steps of:

forming a first conductive layer on a substrate comprising a magnetic material in which said domains can exist, coating said conductive layer with a resist layer, differentially exposing said resist layer to create first and second areas therein which can be differentially developed, developing said resist layer to remove said resist layer completely in said first area and partially in said second area, depositing propagation circuitry for moving bubbles in said magnetic medium and sensing circuitry for detecting bubbles in said magnetic medium, said propagation circuitry and said sensing circuitry comprising a conductive magnetic layer deposited in said first area, further developing said resist layer to remove said resist layer completely from said second area to expose said first conductive layer thereat, depositing a non-magnetic conductive layer on said conductive magnetic layer and on said first conductive layer in said second area, said non-magnetic conductive layer providing electrical connections to said sensing circuitry, removing any remaining undesired portions of said resist layer and further removing any undesired portions of said first conductive layer except in said first and second areas.

* * * * *